US006773307B2

(12) United States Patent
Beer

(10) Patent No.: US 6,773,307 B2
(45) Date of Patent: Aug. 10, 2004

(54) HIGH CURRENT MANUAL DISCONNECT SYSTEM

(75) Inventor: Robert C. Beer, Noblesville, IN (US)

(73) Assignee: Delphi Technologies, Inc., Troy, MI (US)

( * ) Notice: Subject to any disclaimer, the term of this patent is extended or adjusted under 35 U.S.C. 154(b) by 404 days.

(21) Appl. No.: 09/895,829

(22) Filed: Jun. 29, 2001

(65) Prior Publication Data

US 2003/0003807 A1 Jan. 2, 2003

(51) Int. Cl.[7] ..... H01R 13/68
(52) U.S. Cl. ..... 439/621; 439/890
(58) Field of Search ..... 439/621, 622, 439/698, 830, 890, 893, 620, 188; 337/158, 208, 186, 187; 174/50, 58

(56) References Cited

U.S. PATENT DOCUMENTS 3,873,971 A * 3/1975 Hurtle ..... 218/1
4,968,264 A * 11/1990 Ruehl et al. ..... 439/622
5,429,530 A * 7/1995 Zander et al. ..... 439/622
5,963,018 A * 10/1999 Guthrie ..... 320/136
6,049,140 A 4/2000 Alksnat et al.
6,087,737 A 7/2000 Alksnat et al.
6,109,973 A * 8/2000 Gronowicz et al. ..... 439/620
6,261,123 B1 7/2001 Kruger et al.
6,512,441 B1 * 1/2003 Yu ..... 337/7
6,515,226 B2 * 2/2003 Chiriku et al. ..... 174/50

OTHER PUBLICATIONS

Mega® Fuse Fuseholder Information Sheet of Littelfuse, Des Plaines, IL 60016, undated, no date.
Radsok® Electrical Connectors Information Sheet of K&K Stamping, Fraser, MI, dated 1993–1999.

* cited by examiner

*Primary Examiner*—Gary Pauman
*Assistant Examiner*—Edwin A. Leon
(74) *Attorney, Agent, or Firm*—David P. Wood

(57) ABSTRACT

A high current circuit disconnect system includes a fuse, current limiting resistor, a manual disconnection unit, and a holder having a pair of connections for connecting the high current disconnect system to an electrical circuit. The manual disconnection unit is wired in series with the fuse and provides a user selectable circuit interrupt. A first portion of the manual disconnection unit is located in the holder, while a second portion thereof is selectively connectable to the first portion, wherein when in the connected state the path therethrough is closed, but when in the disconnected state, the path therethrough is open. The current limiting resistor is wired in parallel with the manual disconnection unit, and also in series with the fuse.

7 Claims, 3 Drawing Sheets

HIGH CURRENT MANUAL DISCONNECT SYSTEM

TECHNICAL FIELD

The present invention relates to electrical systems, and more particularly to high current electrical systems in which a component thereof is subject to replacement.

BACKGROUND OF THE INVENTION

Electrical systems frequently include replaceable components, as for example fuses. In high current electrical circuits having sufficient voltage, the removal of a component may result in ionization of the air, resulting in an arc discharge as the component looses contact with its mounting member. Arcs of this nature can carry substantial energy, which may result in sufficient heat generation to melt or otherwise damage the component electrical interface and/or its mounting, as well as posing a possible danger of injury to the person performing the extraction. This arc discharge situation, with its concurrent potential for damage and/or injury, may also occur when a component is replaced.

An example of a high current circuit application is the modern automobile. A plethora of electrical devices are now typical in present automobiles, each creating a current draw. These high current electrical circuits have capacitive and inductive aspects which can add transient bursts of current and/or voltage to the circuit. Further, because of the power demand placed upon 12 to 14 volt D.C. automotive electrical systems, consideration is being given to standardize to a higher voltage, for example a 42 volt D.C. electrical system. Higher voltage automotive electrical systems offer reduced current at the same power demand, but the higher voltage may tend to favor arcing when electrical components are proximally separated.

Accordingly, what is needed in the art of high current electrical circuits is a combined system featuring component and personnel protections in the form of fusing, disconnection, and current limitation.

SUMMARY OF THE INVENTION

The present invention is a high current disconnect system featuring high current fusing, manual disconnect, and current limitation.

The high current disconnect system includes a fuse, current limiting resistor, a manual disconnection unit, and a holder having a pair of connections for connecting the high current disconnect system to an electrical (ie., automotive) circuit. The fuse, which provides overload protection, is seated in a fuse compartment of the holder and is selectively removable therefrom. The manual disconnection unit is wired in series with the fuse and provides a user selectable circuit interrupt. A first portion of the manual disconnection unit is located in a disconnect compartment of the holder and has the aforesaid series wiring connection, while a second portion thereof is selectively connectable to the first portion, wherein when in the connected state the path therethrough is closed, but when in the disconnected state, the path therethrough is open. The current limiting resistor is wired in parallel with the manual disconnection unit (and also in series with the fuse), and is located in a resistor compartment of the holder. The current limiting resistor provides a current limited path for capacitive and/or inductive elements of the connected electrical circuit during charge or disconnect. In this regard, it will be noted that the parallel arrangement of the manual disconnect and current limiting resistor provides a very low resistance, high current path when the manual disconnect is in its connected state, and a current limited path when the manual disconnect is in its disconnected state. Each of the aforesaid compartments are distinct and a respective cover is provided for each compartment.

The second portion of the manual disconnection unit includes a housing and a bussing assembly. The bussing assembly includes a pair of second terminals which erupt from the housing and a buss bar located within the housing which provides a very low resistance electrical connection between the first terminals. The first portion of the manual disconnection unit includes a pair of first terminals which are configured to connect to the second terminals by a slidable interface therebetween. The housing is structured to adjacently occlude the compartment covers when the first terminals are interfaced with the second terminals (that is, when the manual disconnection unit is in the connected state). Accordingly, to access the fuse or the current limiting resistor, the removable portion of the manual disconnection unit must be separated from the holder (whereupon the manual disconnection unit is in the disconnected state).

Benefits of the present invention include: current limitation and electrical isolation during service of the electrical circuit; multitudinal fuse configurations; small, application specific configurable package; expandability not limited by the number of electrical circuits involved; high reliability involving minimal cabling and components; adaptability to any fusing system; and suitability for integration with existing pre-validated components.

Accordingly, it is an object of the present invention to provide a single package high current manual disconnect system including manual disconnection, fusing and current limitation.

This and additional objects, features and advantages of the present invention will become clearer from the following specification of a preferred embodiment.

DESCRIPTION OF THE PREFERRED EMBODIMENT

Figure 1:
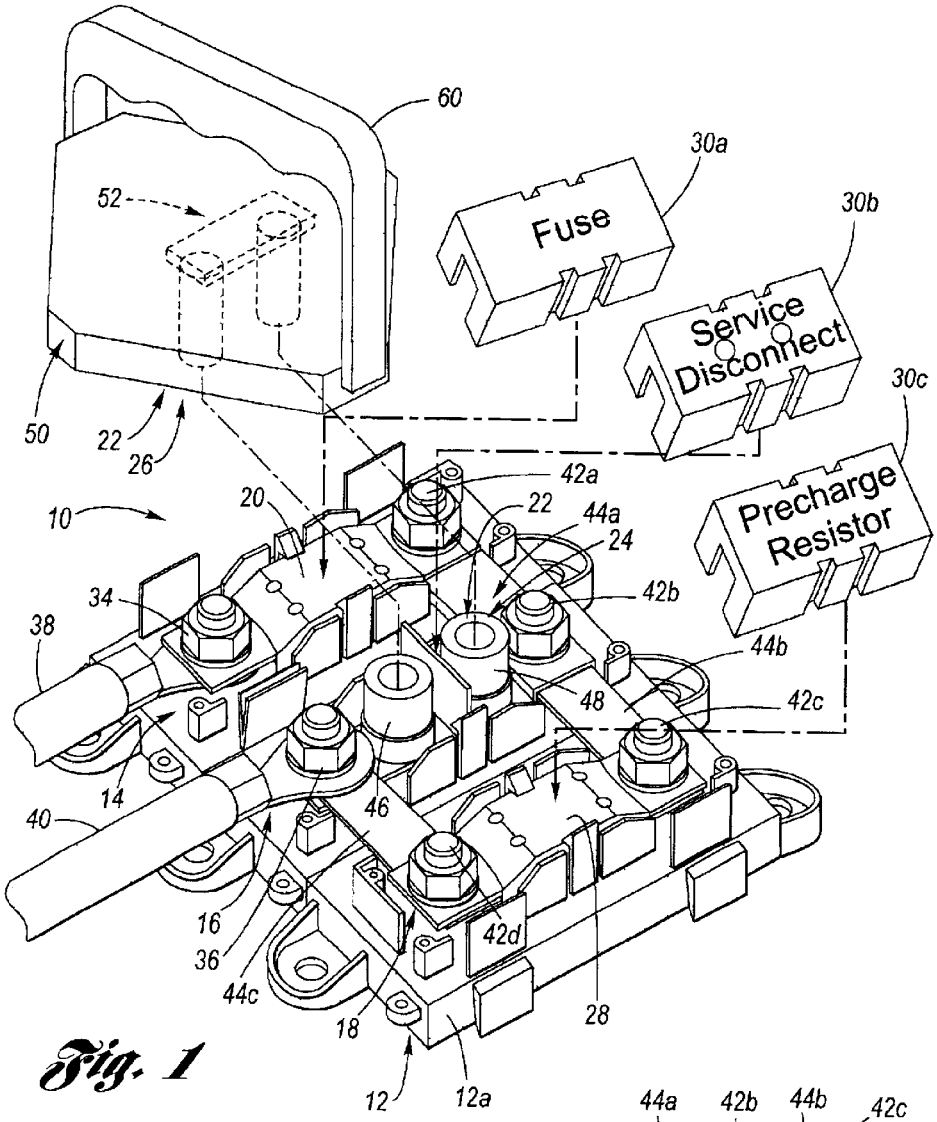
FIG. 1 is an exploded, perspective view of the high current manual disconnect system according to the present invention, shown connected to an external electrical circuit.

Referring now to the Drawing, FIG. 1 depicts a preferred example of a high current manual disconnect system 10, including a holder 12 having a fuse compartment 14, a disconnect compartment 16 and a resistor compartment 18; a fuse 20 located in the fuse compartment; a manual disconnection unit 22 having a first (base) portion 24 located in the disconnect compartment and a second (removable) portion 26; and a current limiting resistor 28 located in the resistor compartment. Each of the compartments is covered by a removable cover: the fuse compartment 14 by a fuse compartment cover 30*a*, the disconnect compartment by a disconnect compartment cover 30*b*, and the resistor compartment 18 by a resistor compartment cover 30*c*. Each compartment cover 30*a*, 30*b*, 30*c* is snappingly interfaced with a holder body 12*a* of the holder 12 so as to be selectively removable therefrom. The compartment covers 30*a*, 30*b*, 30*c* serve environmental protection, electrical isolation, and prevention of accidental electrical contact by personnel.

The holder body 12*a* is composed of an electrical insulator, as for example glass filled thermoplastic. The holder body 12*a* has attached thereto a pair of contacts 34, 36 to which is respectively connected wires 38, 40 from an external electrical circuit, as for example a high current automotive electrical circuit. Preferably, the contacts 34, 36 are of the threaded stud and nut type, but may be otherwise configured. Additional contacts 42*a*, 42*b*, 42*c*, 42*d* are also provided, wherein the fuse 20 is connected to contacts 34 and 42*a*, the first portion 26 is connected to contacts 36 and 42*b*, and the current limiting resistor 28 is connected to contacts 42*c* and 42*d*. A first buss bar 44*a* connects contact 42*a* to contact 42*b*, a second buss bar 44*b* connects contact 42*b* to contact 42*c*, and a third buss bar 44*c* connects contact 42*d* to contact 36. A preferred holder is a MEGA® Fuse fuseholder manufactured by Littelfuse of Des Plaines, Ill., which features the ability to customize the holder body by addition or deletion of compartments with appropriate bussing.

Figure 2:
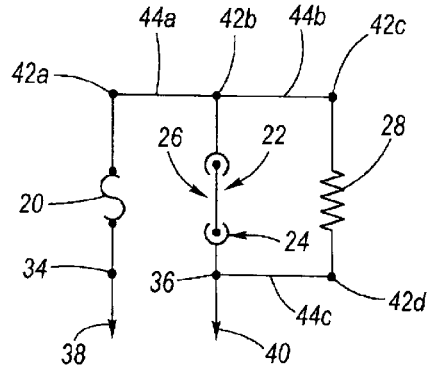
FIG. 2 is an electrical circuit diagram for the high current manual disconnect system according to the present invention.

As further indicated by FIG. 2, the preferred example of the manual disconnect system 10 is wired as follows. The fuse 20, which provides circuit overload protection, is seated in the fuse compartment 14 and is selectively removable therefrom by operation of contacts 34 and 42*a*. The manual disconnection unit 22 is wired in series with the fuse 20 and provides a user selectable circuit interrupt. In this regard, the first portion 24 thereof is located in the disconnect compartment and has a left first terminal 46 connected to the contact 36 and a right first terminal 48 connected to contact 42*b* (note that the left and right first terminals do not mutually contact each other), while the second portion 26 thereof is selectively connectable to the first portion so as to selectively close the electrical path between contacts 36 and 42*b*. The current limiting resistor 28 is wired in parallel with the manual disconnection unit 22 (and also in series with the fuse 20), and is located in the resistor compartment 18.

In operation of the electrical circuit of the preferred example of the manual disconnect system 10, the fuse opens the circuit if the current becomes larger then a predetermined maximum. The current limiting resistor provides a current limited path for capacitive and/or inductive elements of the connected electrical circuit during charge or disconnect. The choice of resistor is determined by the amount of circuit capacitance/inductance, circuit charge/discharge time constant, and maximum circuit safe charge current. The manual disconnection unit provides a high current, very low resistance current path for powering the circuit. In this regard, it will be noted that the parallel arrangement of the manual disconnection unit 22 and current limiting resistor 28 provides for components to be charged so that even as the first and second portions of the manual disconnection unit are separated, removal the fuse will not involve arcing, as all components having capacitance and inductance will be charged/discharged under current limited conditions.

Figure 6:
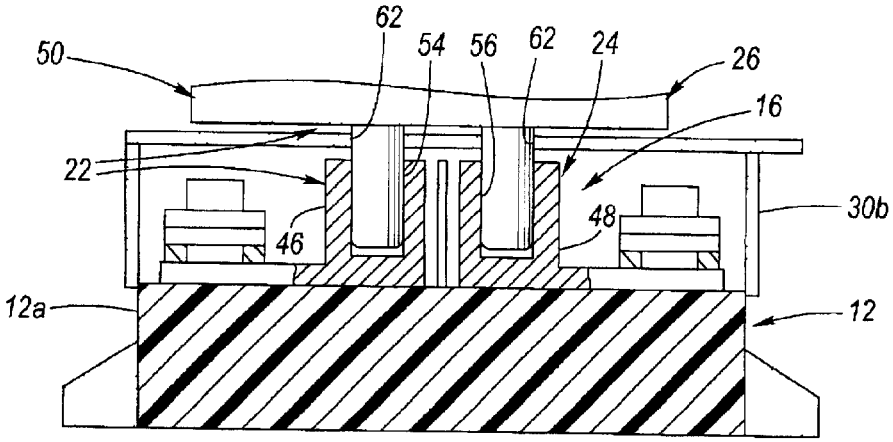
FIG. 6 is a partly sectional, broken away view of the high current manual disconnect system, wherein the manual disconnection unit is in the connected state.

The second portion 26 of the manual disconnection unit 22 includes a housing 50 and a bussing assembly 52. The bussing assembly 52 includes left and right second terminals 54, 56 which erupt from a bottom wall 50*a* of the housing 50, and further includes a buss bar 58 located within the housing and connected to the left and right first terminals so as to provide a very low resistance electrical connection therebetween. A pivotally mounted handle 60 is connected to the housing 50 for grasping opposite the bottom wall. The first portion 24 of the manual disconnection unit 22 includes the aforementioned pair of left and right second terminals 46, 48 which are configured to connect to the left and right first terminals 54, 56 by a slidable interface. The preferred form of left and right second terminals 54, 56 are male pin terminals, and the preferred form of left and right first terminals 46, 48 are female barrel terminals, as for example RADSOK® electrical connectors manufactured by Konnektech Division of K&K Stamping of Fraser, Mich. The disconnection cover 30*b* is provided with a pair of holes 62 through which the left and right second terminals 54, 56 pass so that they may be connected with the left and right first terminals 46, 48, as shown at FIG. 6.

When the second portion 26 of the manual disconnection unit 22 is mated to its first portion 24, the manual disconnection unit is in its connected state, and electricity passes under very low resistance therethrough. When the second portion 26 of the manual disconnection unit 22 is unmated from its first portion 24 by a user pulling upon the handle 60, the manual disconnection unit is in its disconnected state, and electricity cannot pass therethrough (however, current limited by the current limiting resistor 28 can alternatively pass parallel thereto).

Figure 3:
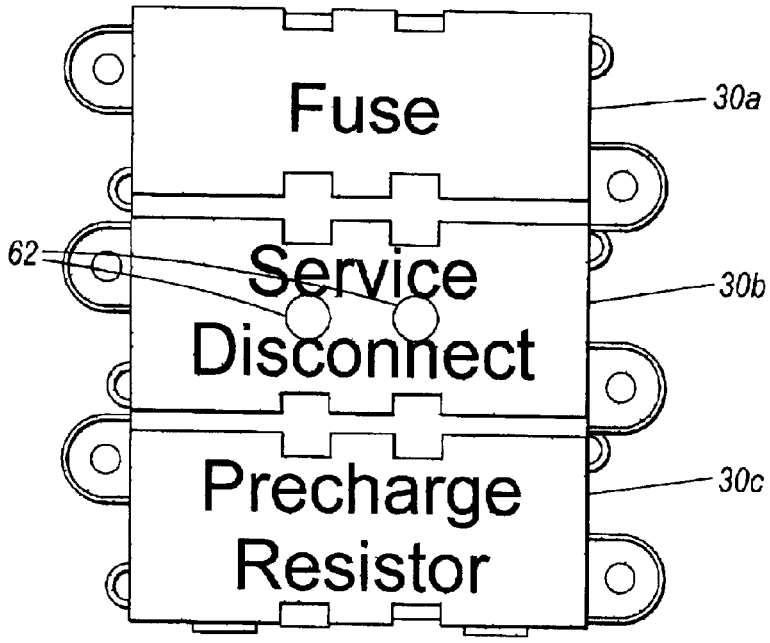
FIG. 3 is a top plan view of the holder of the high current manual disconnect system, wherein the manual disconnection unit is in the disconnected state.
Figure 4:
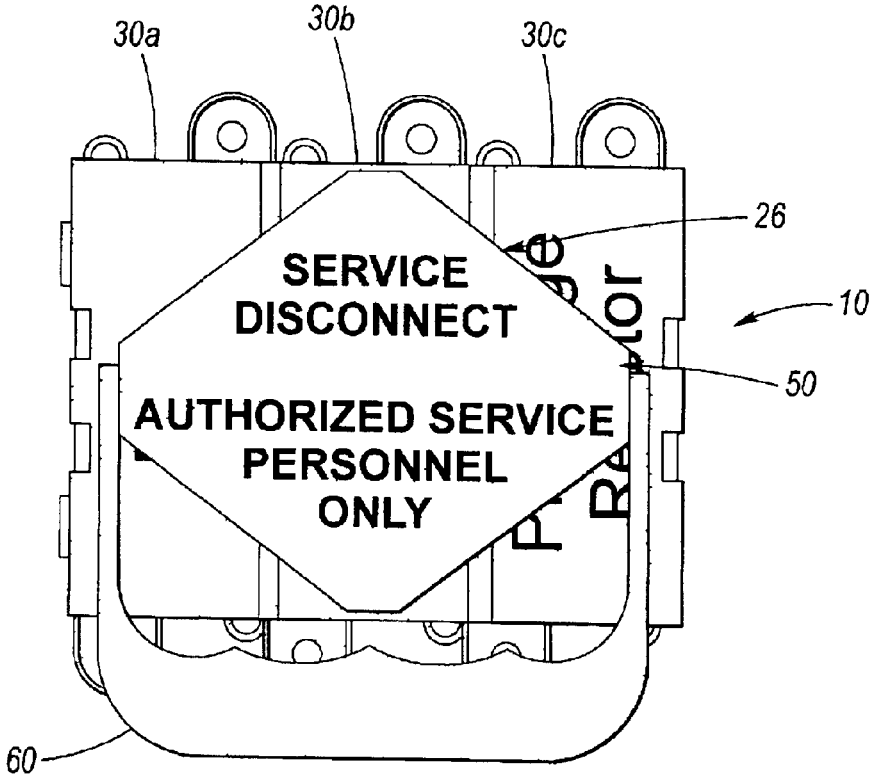
FIG. 4 is a top plan view of the high current manual disconnect system, wherein the manual disconnection unit is in the connected state.
Figure 5:
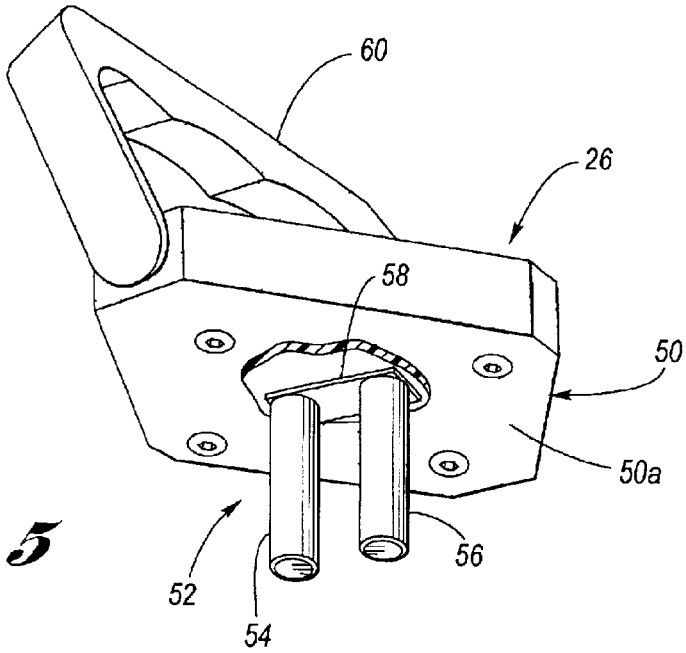
FIG. 5 is a partly sectional, perspective view of the bus assembly of the removable portion of the manual disconnection unit of the high current manual disconnect system.

The housing 50 is structured to adjacently occlude the fuse, disconnect and resistor compartment covers 30*a*, 30*b*, 30*c*, when the manual disconnection unit 22 is in the connected state, as shown at FIG. 4. Accordingly, to service the fuse (or the first portion 24 of the manual disconnection unit 22 or the current limiting resistor 28), the manual disconnection unit 22 must be in the disconnected state, whereat the removable portion of the manual disconnection unit is separated from the holder, so that the covers may be removed (see FIG. 3).

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A manual disconnect system for an electrical circuit, comprising:

a holder;

a fuse located within said holder;

a manual disconnection unit comprising a first portion located in said holder and a second portion selectively connected to said first portion; and a current limiting resistor located in said holder;

wherein said current limiting resistor and said manual disconnection unit are mutually connected in parallel and said fuse is connected in series with said current limiting resistor and said manual disconnection unit; and wherein when said first portion is connected to said second portion, said manual disconnection unit is in a connected state whereat a low resistance electrical path is provided therethrough, and wherein when said first portion is disconnected from said second portion said manual disconnection unit is in a disconnected state whereat the electrical path is broken;

the system further comprising:

at least one cover which removably interfaces with said holder so as to cover said fuse, said manual disconnection unit and said current limiting resistor; and a housing connected with said second portion, wherein said housing adjacently occludes said at least one cover when said manual disconnection unit is in the connected state so as to prevent removal of said at least one cover unless said manual disconnection unit is in the disconnected state.

2. The system of claim 1, wherein said holder comprises:

a fuse compartment receiving said fuse;

a disconnect compartment receiving said first portion; and a resistor compartment receiving said high current resistor; and wherein said at least one cover comprises:

a fuse cover removably covering said fuse compartment;

a disconnect cover removably covering said first portion, said disconnect cover having a pair of holes formed therein; and a resistor cover removably covering said resistor compartment, wherein when said manual disconnection unit is in the connected state, said housing adjacently occludes each of said fuse, disconnect and resistor covers.

3. The system of claim 2, wherein said first portion comprises a pair of first terminals located in said holder, and wherein said second portion comprises a buss assembly comprising a pair of second terminals and a buss bar connecting together said pair of second terminals; and wherein when said manual disconnect unit is in the connected state said first and second terminals are mutually connected through the holes formed in said disconnect cover.

4. The system of claim 3, further comprising a handle connected to said housing.

5. A manual disconnect system for an electrical circuit, comprising:

a holder comprising a fuse compartment, a disconnect compartment, and a resistor compartment;

a fuse located within said fuse compartment;

a manual disconnection unit comprising a first portion located in said disconnect compartment and a second portion selectively connected to said first portion, said second portion having a housing;

a current limiting resistor located in said resistor compartment; and at least one cover removably covering said fuse, disconnect and resistor compartments;

wherein said current limiting resistor and said manual disconnection unit are mutually connected in parallel and said fuse is connected in series with said current limiting resistor and said manual disconnection unit;

wherein when said first portion is connected to said second portion, said manual disconnection unit is in a connected state whereat a low resistance electrical path is provided therethrough, and wherein when said first portion is disconnected from said second portion said manual disconnection unit is in a disconnected state whereat the electrical path through the manual disconnection unit is broken; and wherein said housing adjacently occludes said at least one cover when said manual disconnection unit is in the connected state so as to prevent removal of said at least one cover unless said manual disconnection unit is in the disconnected state.

6. The system of claim 5, wherein said first portion comprises a pair of first terminals located in said holder, and wherein said second portion comprises a buss assembly comprising a pair of second terminals and a buss bar connecting together said pair of second terminals; and wherein when said manual disconnect unit is in the connected state said first and second terminals are mutually connected through the holes formed in said disconnect cover.

7. The system of claim 6, further comprising a handle connected to said housing.

* * * * *